US010329748B2

(12) United States Patent
Hall et al.

(10) Patent No.: US 10,329,748 B2
(45) Date of Patent: Jun. 25, 2019

(54) SINK SYSTEM WITH FAUCET IN SINK COVER

(71) Applicants: David R. Hall, Provo, UT (US); Andrew Priddis, Mapleton, UT (US); Joseph Blanch, Provo, UT (US); Braquel Burnett, St. Geroge, UT (US)

(72) Inventors: David R. Hall, Provo, UT (US); Andrew Priddis, Mapleton, UT (US); Joseph Blanch, Provo, UT (US); Braquel Burnett, St. Geroge, UT (US)

(73) Assignee: Hall Labs LLC, Provo, UT (US)

( * ) Notice: Subject to any disclaimer, the term of this patent is extended or adjusted under 35 U.S.C. 154(b) by 13 days.

(21) Appl. No.: 15/296,348

(22) Filed: Oct. 18, 2016

(65) Prior Publication Data

US 2018/0106021 A1 Apr. 19, 2018

(51) Int. Cl.

| | |
|---|---|
| ***E03C 1/04*** | (2006.01) |
| ***E03C 1/05*** | (2006.01) |
| ***E03C 1/18*** | (2006.01) |

(52) U.S. Cl.

CPC ..... *E03C 1/0404* (2013.01); *E03C 1/055* (2013.01); *E03C 1/057* (2013.01); *E03C 1/18* (2013.01); *E03C 2001/0417* (2013.01); *E03C 2001/0418* (2013.01)

(58) Field of Classification Search

CPC .. E03C 2001/0417; E03C 1/057; E03C 1/055; E03C 2001/0404; E03C 2001/0414; A47K 1/02

See application file for complete search history.

(56) References Cited

U.S. PATENT DOCUMENTS

| | | | | | |
|---|---|---|---|---|---|
| 616,106 | A * | 12/1898 | Houston | 4/630 | |
| 1,289,225 | A * | 12/1918 | Montan | A47K 1/02 | 296/37.1 |
| 2,121,866 | A * | 6/1938 | Fredrikson | E03C 1/186 | 134/115 R |
| 4,844,944 | A * | 7/1989 | Graefe | A47K 3/00 | 156/310 |
| 5,815,855 | A * | 10/1998 | McKeehan | E03C 1/186 | 165/185 |
| 5,868,311 | A * | 2/1999 | Cretu-Petra | E03C 1/057 | 236/12.12 |
| 8,572,772 | B2 * | 11/2013 | Wolf | E03C 1/057 | 4/623 |
| 2009/0100595 | A1 * | 4/2009 | Kozacki | E03C 1/0401 | 4/695 |
| 2014/0165286 | A1 * | 6/2014 | Abello Jimenez | A47B 77/06 | 4/676 |

* cited by examiner

*Primary Examiner* — Janie M Loeppke

(57) ABSTRACT

The invention is a sink system in which a faucet is embedded within a sink cover. This allows a user to completely cover a sink, making the sink space available for other work without the inconvenience of disposing of a separate faucet fixture. The invention comprises a sink basin and a hinged sink cover attached to the basin. The sink cover fits exactly within the sink basin. The sink cover doubles as a faucet. It has a channel, which may extend entirely or partially through the sink cover, which directs a flow of water from a source of water, through the channel, and into the sink basin. The sink system may also have sensors and valves to control temperature and water flow, a digital display panel that displays temperature and flow rate, a user interface, or a visual indictor of water temperature, preferably by means of LED lights.

19 Claims, 7 Drawing Sheets

SINK SYSTEM WITH FAUCET IN SINK COVER

CROSS REFERENCES

Technical Field

This invention relates generally to the field of sinks, and more specifically to sink covers and faucets.

Background

A sink is an important component of many work surfaces. From hand washing to soaking dishes, a sink serves countless useful purposes. However, there are times when the presence of a sink inconveniently limits the amount of work surface available.

In response to popular demand for workspaces that are able to adapt to varying user requirements, some sink designs allow the sink to be covered and hidden when a user requires a larger work surface. Sink covers solve the problem of extending the surface area of a work surface by covering the sink basin. However, there is often still a problem, in that the protruding faucet may continue to interfere with the workspace.

To solve this problem, some sinks have been designed with retractable faucets, but this increases the complexity of the sink design with the addition of moving parts. It also still requires an opening for when the faucet is lifted up. Another solution has been to embed the faucet within the adjacent counter space. However, once again, an opening is left in the work surface. Furthermore, many designs require a user to manually extend some part of the embedded faucet before it becomes functional.

In light of the foregoing, what is needed is a sink that utilizes a faucet that can be embedded inside of a sink cover, such that the presence of the faucet will not interfere with work space. Furthermore, current sink designs integrate various technologies that make them ever more convenient to use. For example, many sinks utilize means to turn on without physical contact, visual or audio indicators of water temperature, inputs for controlling water temperature, inputs for dispensing a designated quantity of water, or digital user interfaces that allow users to digitally control features like temperature and flow rate and display this information to the user. Therefore, an ideal sink system would also utilize these various other technologies.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow a faucet to be embedded within a sink cover.

Consistent with the foregoing, a sink system is disclosed. The sink system comprises a sink basin and an articulated sink cover. The articulated sink cover comprises a periphery that fits proximate to a periphery of the sink basin. The articulated sink cover also comprises a faucet. The faucet comprises a channel in communication with a water source and the sink basin. The faucet directs a flow of water from the water source, through the channel, and into the sink basin.

The articulated sink cover may comprise various materials or configurations. In a preferred embodiment, the articulated sink cover is attached to the sink basin by means of hollow, cylindrical hinges. In a preferred embodiment, the channel communicates with the water source by means of a hose fitting and flexible piping, and the flexible piping may run through the hollow, cylindrical hinges. The flexible piping may also extend into the channel. In different embodiments, the channel is cylindrical, measures less than approximately one inch (2.54 cm.) in diameter, is fitted with a directional nozzle, or extends entirely or less than entirely through the articulated sink cover.

In certain embodiments, the sink system comprises sensors and valves to control temperature and water flow. In certain embodiments, the sink system comprises a digital display panel that displays a temperature and a flow rate of the water. In some embodiments, the sink system comprises a user interface, which may be controlled by gestures or voice. In some embodiments, the sink system comprises a visual indicator of water temperature, preferably by means of colored lights.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
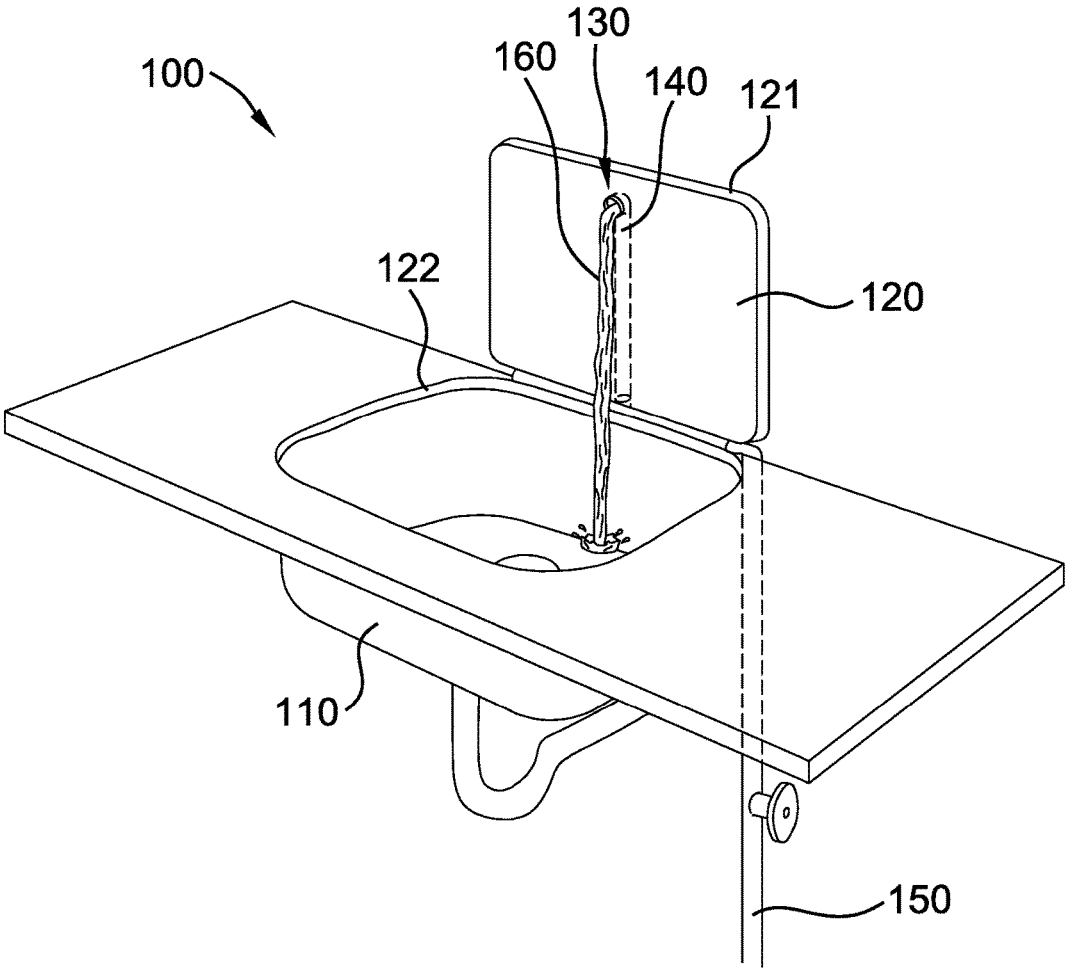
FIG. 1 depicts one embodiment of the invented sink system.

FIG. 1 depicts one embodiment of a sink system 100 comprising a sink basin 110 and an articulated sink cover 120. The articulated sink cover 120 comprises a periphery 121 that fits proximate to a periphery 122 of the sink basin 110. The articulated sink cover 120 further comprises a faucet 130. The faucet 130 comprises a channel 140 in communication with a water source 150 and the sink basin 110. The faucet 130 directs a flow of water 160 from the water source 150 through the channel 140 into the sink basin 110.

Figure 2A:
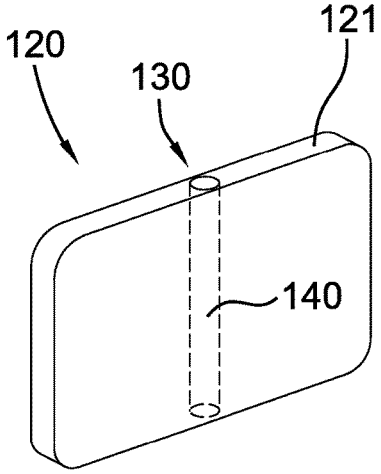
FIG. 2A depicts one embodiment of an articulated sink cover in which a channel extends entirely through the articulated sink cover.
Figure 2B:
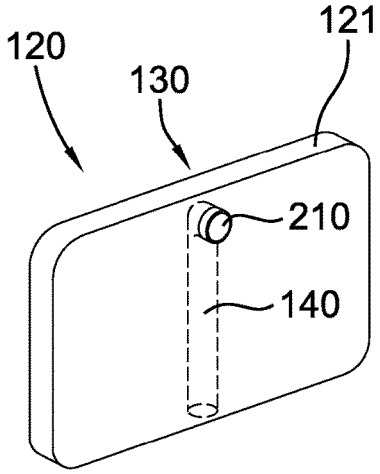
FIG. 2B depicts one embodiment of an articulated sink cover in which a channel extends nearly entirely through the articulated sink cover.
Figure 2C:
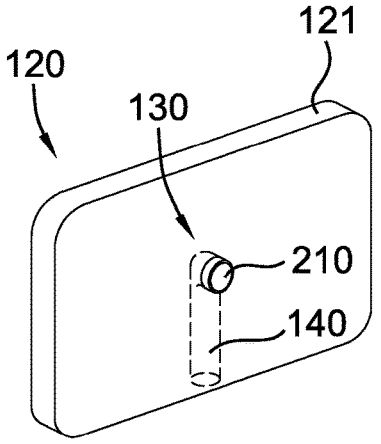
FIG. 2C depicts one embodiment of an articulated sink cover in which a channel extends halfway through the articulated sink cover.
Figure 2D:
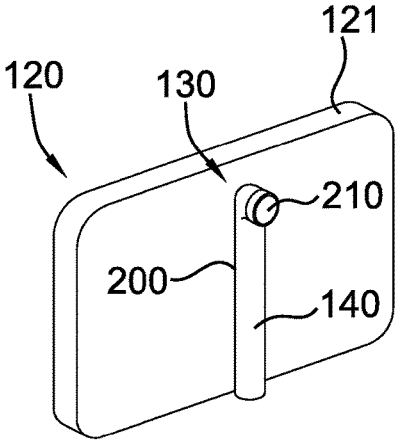
FIG. 2D depicts one embodiment of an articulated sink cover in which a channel is located within a separate fixture.

FIG. 2A-FIG. 2D depict embodiments of an articulated sink cover 120. The articulated sink cover 120 comprises a periphery 121 that fits proximate to a periphery 122 of a sink basin 110. In one embodiment, the articulated sink cover 120 comprises a substantially rectangular configuration, with rounded corners. In another embodiment, the articulated sink cover 120 comprises a round configuration. In other embodiments, the articulated sink cover 120 comprises a different configuration. In each embodiment, the configuration of the articulated sink cover 120 is the same as the configuration of the periphery 122 of the sink basin 110. In one embodiment, the articulated sink cover 120 is cut out from a counter top. In a preferred embodiment, the articulated sink cover 120 comprises acrylic polymer and alumina trihydrate, such as Corian. In other embodiments, the articulated sink cover 120 comprises a synthetic plastic polymer—such as cross-linked polyethylene (PEX), chlorinated polyvinyl chloride (CPVC), or polypropylene—or metal—such as aluminum, copper, steel, or stainless steel. The articulated sink cover 120 further comprises a faucet 130. The faucet 130 comprises a channel 140 in communication with a water source 150 and the sink basin 110. The faucet 130 directs a flow of water 160 from the water source 150 through the channel 140 into the sink basin 110. In a preferred embodiment, the channel 140 comprises a cylindrical configuration. In a preferred embodiment, the channel 140 measures less than approximately one inch (2.54 cm.) in diameter. The channel 140 is preferably the same size as pipes of the water source 150. In a preferred embodiment, the channel 140 is inside the articulated sink cover 120. The channel 140 inside the articulated sink cover 120 can be drilled or created by attaching two halves of the articulated sink cover 120, each with an indented half of the channel 140, together. In one embodiment, the channel 140 extends entirely through the articulated sink cover 120. This embodiment is depicted in FIG. 2A. In other embodiments, the channel 140 extends partway through the articulated sink cover 120. FIG. 2B depicts one embodiment in which the channel 140 extends nearly entirely through the articulated sink cover 120. FIG. 2C depicts one embodiment in which the channel 140 extends halfway through the articulated sink cover 120. In another embodiment, a separate fixture 200 is attached to the exterior of the articulated sink cover 120, the channel 140 being located within the separate fixture 200. This separate fixture 200 may resemble the kind of metal, cylindrical faucet found on most traditional sink systems. FIG. 2D depicts this embodiment. In a preferred embodiment, the channel 140 comprises a directional nozzle 210, as depicted in FIG. 2B, FIG. 2C, and FIG. 2D. In some embodiments, the articulated sink cover 210 can be folded into two halves or into more pieces. Flexible pipes extended into the channel 140 would allow the articulated sink cover 120 to be bendable but still allow the faucet 130 to direct the flow of water 160.

Figure 3B:
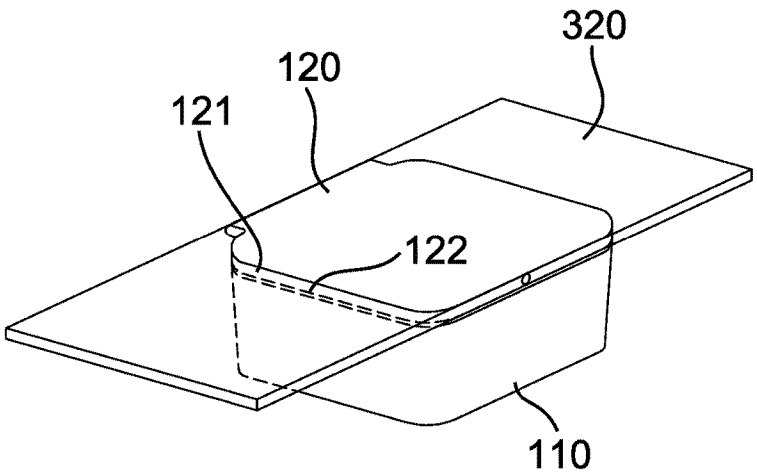
FIG. 3B depicts an articulated sink cover attached to a sink basin with the articulated sink cover closed.
Figure 3A:
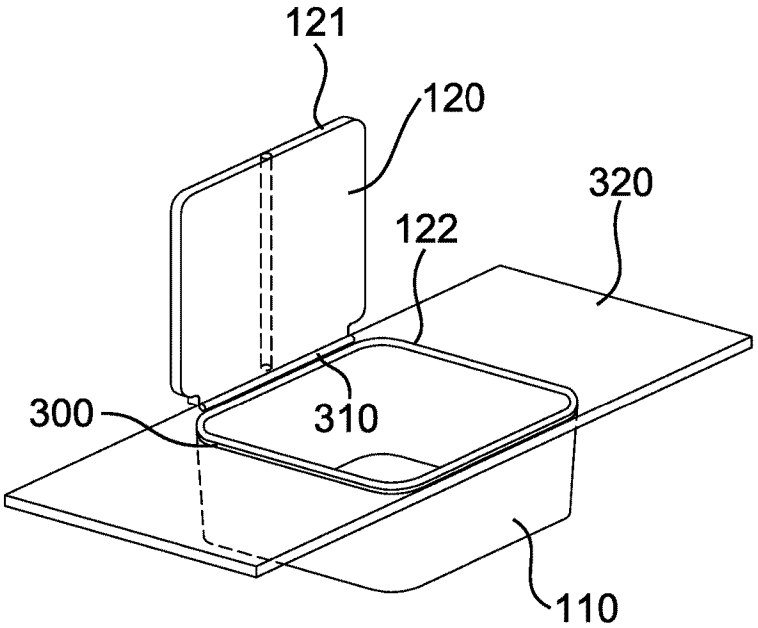
FIG. 3A depicts an articulated sink cover attached to a sink basin with the articulated sink cover lifted.

FIG. 3A and FIG. 3B depict embodiments of an articulated sink cover 120 attached to a sink basin 110. The term sink basin includes all forms of washbasins, sinks, other basins, or baths with water drainage. The articulated sink cover 120 comprises a periphery 121 that fits proximate to a periphery 122 of the sink basin 110. In a preferred embodiment, the articulated sink cover 120 fits exactly within the sink basin 110, such that no cracks or gaps are visible between the periphery of each. In another embodiment, the articulated sink cover 120 rests on top of the periphery 122 of the sink basin 110. In a preferred embodiment, the periphery 122 of the sink basin 110 comprises a substantially rectangular configuration. In another embodiment, the periphery 122 of the sink basin 110 comprises a round configuration. Other embodiments may have other configurations. In one embodiment, the sink basin 110 comprises a gasket 300 around the periphery 122 thereof, providing a water tight seal. The gasket 300 may comprise a flat sheet of rubber, cork, Teflon, or a plastic polymer. In a preferred embodiment, the articulated sink cover 120 is attached to the sink basin 110. The attachment may occur by means of any type of hinge 310, which makes the sink cover articulable. In a preferred embodiment, the articulated sink cover 120 is attached to the sink basin 110 by means of hollow, cylindrical hinges, which may extend the length of one side of the periphery 122 of the sink basin 110. Using this type of hinge 310 allows the articulated sink cover 120 to be suspended with strength and steadiness. It also allows flexible pipes from the water source 150 to be inserted within the hinge 310 so that the pipes will not protrude inconveniently from the back of the sink system 100, and so that the pipes will not be visible, improving the aesthetic appeal. FIG. 3A depicts an articulated sink cover 120 attached to a sink basin 110 with the articulated sink cover 120 lifted such that the hinge 310 is visible. FIG. 3B depicts an articulated sink cover 120 attached to a sink basin 110 with the articulated sink cover 120 closed over the sink basin 110. When the articulated sink cover 120 is closed, it becomes available for counter or desk space, merging itself with any counter or desk space 320 available next to the sink basin 110.

Figure 4C:
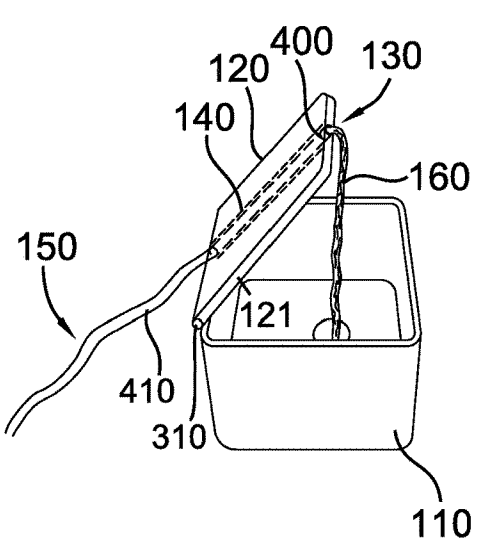
FIG. 4C depicts one embodiment of a faucet comprising a channel in communication with a water source and the sink basin.
Figure 4B:
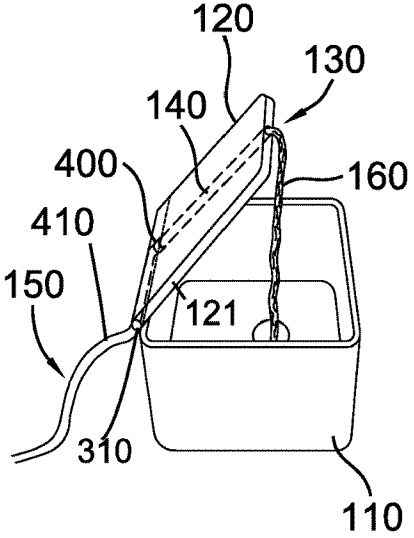
FIG. 4B depicts one embodiment of a faucet comprising a channel in communication with a water source and the sink basin.
Figure 4A:
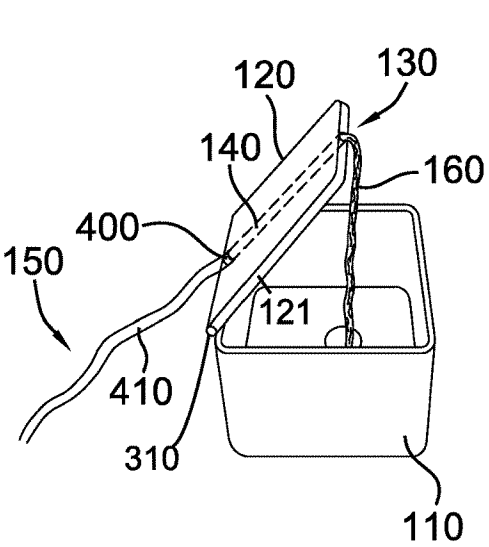
FIG. 4A depicts one embodiment of a faucet comprising a channel in communication with a water source and the sink basin.

FIG. 4A-FIG. 4C depict embodiments of the faucet 130 comprising a channel 140 in communication with a water source 150 and the sink basin 110. The faucet 130 directs a flow of water 160 from the water source 150 through the channel 140 into the sink basin 110. In a preferred embodiment, the channel 140 communicates with the water source 150 by means of a hose fitting 400 and flexible piping 410. In a preferred embodiment, the hose fitting 400 is a barbed hose fitting. In some embodiments, the hose fitting 400 is T-shaped. In some embodiments, there is no hose fitting 400. In one embodiment, as depicted in FIG. 4A, the hose fitting 400 is attached inside the channel 140 at the lowermost portion of the periphery 121 of the articulated sink cover 120 (the channel may be located within a separate fixture 200 attached to the exterior of the articulated sink cover 120). The hose fitting 400 may be affixed above or through the hinge 310, if the hinge 310 extends the entire length of the lowermost portion of the periphery 121, or between or next to one or more hinges 310 that do not extend the entire length of the lowermost portion of the periphery 121. The flexible piping 410 is connected to and extends out from the hose fitting 400. In one embodiment, there is one hose fitting 400 connected to one piece of flexible piping 410. In another embodiment, there is one T-shaped hose fitting 400 connected to two flexible pipes 410, one for hot water and one for cold water. In a preferred embodiment, as depicted in FIG. 4B, the hinge 310 is cylindrical and hollow. The hose fitting 400 is attached inside the channel 140 near the lowermost portion of the periphery 121 of the articulated sink cover 120. The flexible piping 410 is connected to the hose fitting 400, and strung through the hollow, cylindrical hinge 310. In one such embodiment, the hose fitting 400 is T-shaped and connected to two pieces of flexible piping 410, which are strung out through the hollow, cylindrical hinge 310 in two opposite directions. One piece of flexible piping 410 is for hot water, and one is for cold water. In still another embodiment, which is depicted in FIG. 4C, the hose fitting 400 is attached inside the channel 140 at the uppermost periphery 121 of the articulated sink cover 120. The flexible piping 410 is connected to the hose fitting 400, extending into and down through the channel 140 and out the lowermost periphery 121 of the articulated sink cover 120. Each piece of flexible piping 410 is connected to water supply pipes and valves of a plumbing system.

Figure 5:
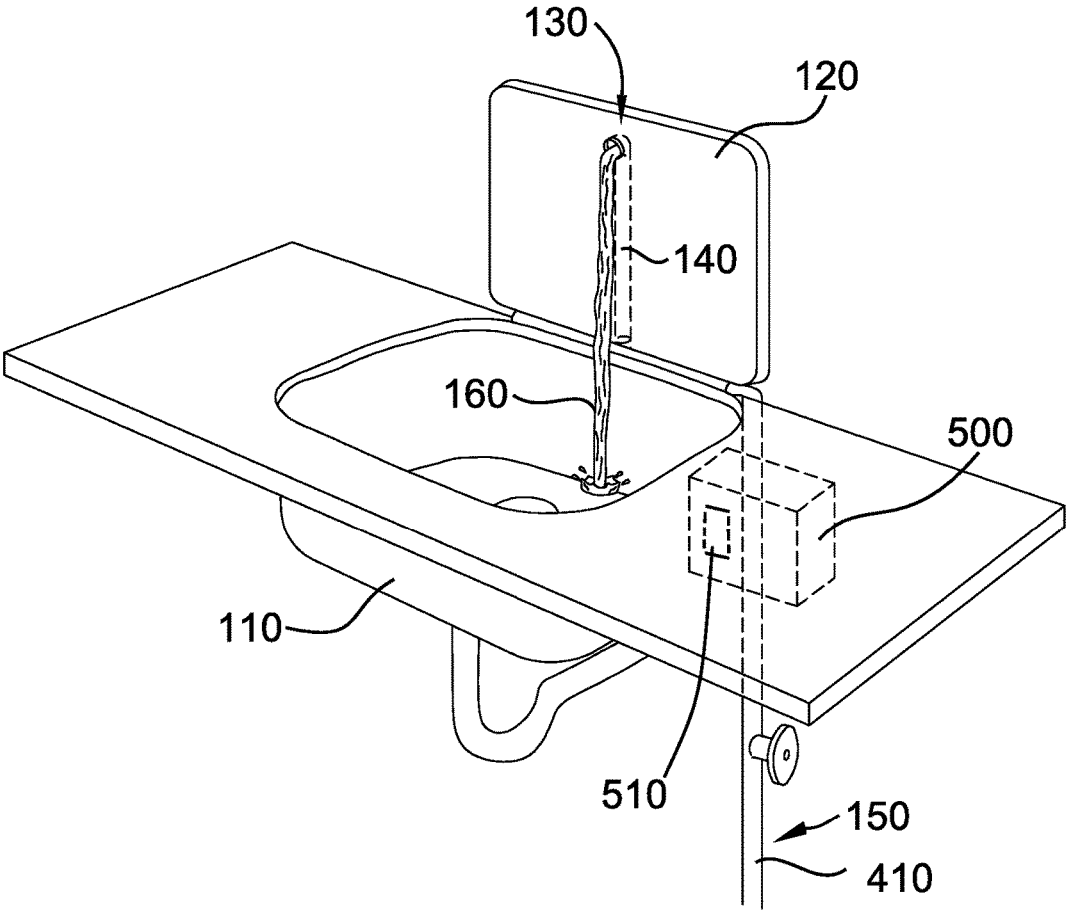
FIG. 5 depicts one embodiment of the sink system comprising one or more sensors and one or more valves to control temperature and water flow.

FIG. 5 depicts one embodiment of the sink system 100, comprising one or more sensors 510 and one or more valves 500 to control temperature and water flow. The flow of water 160 is started and stopped when the one or more valves 500 open and close within the flexible piping 410. In a preferred embodiment, one valve 500 is attached to one piece of flexible piping 410 of the water source 150. The one piece of flexible piping 410 transports hot water mixed with cold water. The hot water and the cold water are mixed and the temperature fixed in a hot water heater before entering the flexible piping 410. In another embodiment, two valves are attached to two pieces of flexible piping 410 of the water source 150, and one piece of flexible piping 410 transports cold water and the other piece of flexible piping 410 transports hot water. The hot water and the cold water are mixed when they emerge from the flexible piping 410 into the channel 140 of the articulated sink cover 120. In one embodiment, the one or more valves 500 are controlled by handles, which may be hot and cold handles. In a preferred embodiment, the one or more valves 500 are electronic valves controlled by a user interface and digital display next to the sink basin 110. In a preferred embodiment, the one or more valves 500 are part of a valve assembly that also comprises one or more sensors 510. The sensors 510 may also be located next to the valves 500, without a valve assembly. A preferred embodiment of the sink system 100 comprises a sensor 510 that monitors the flow rate of the water. In one embodiment, a user can send a request for a certain amount of water via a user interface. The sensor 510 that monitors water flow rate and the valve 500 will work together to measure and release the certain amount of water into the flexible piping 410 and out through the faucet 130. A preferred embodiment of the sink system 100 also comprises a sensor 510 that monitors temperature. In one embodiment, a user can send a request for a certain temperature of water. The sensor 510 that monitors temperature and the valve 500 will work together with a water heater connected to the water source 150 to release water of a certain temperature.

Figure 6:
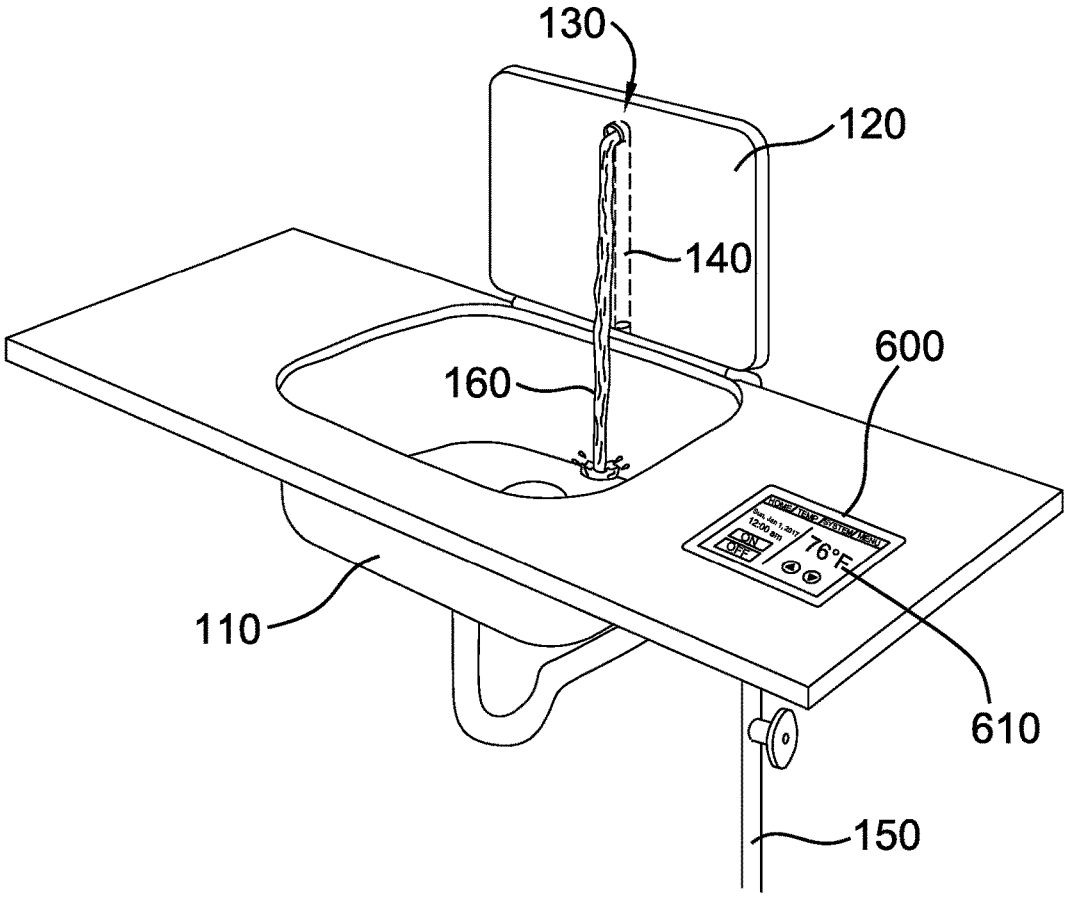
FIG. 6 depicts one embodiment of the sink system comprising a user interface and a digital display panel.

FIG. 6 depicts one embodiment of the sink system 100 comprising a user interface 600 and a digital display panel 610 that displays a temperature and a flow rate of the water. In one embodiment, the user interface 600 is controlled by hand gestures. In another embodiment, the user interface 600 is voice controlled. In other embodiments, the user interface 600 may have buttons or switches. In a preferred embodiment, the one or more valves 500 are electronic valves controlled by the user interface 600. By means of the user interface 600, a user can turn water on or off, request water of a certain temperature, or request water in certain amounts.

Figure 7:
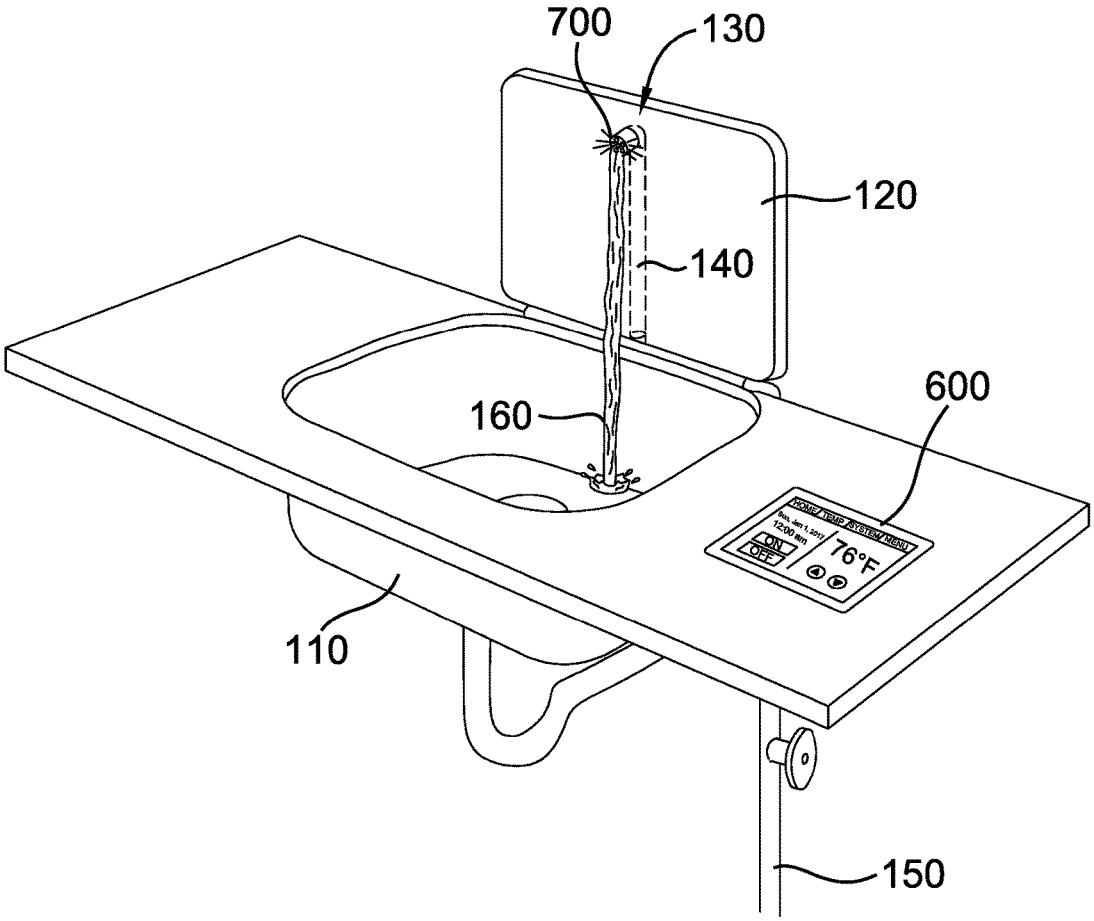
FIG. 7 depicts the sink system comprising a visual indicator of water temperature.

FIG. 7 depicts the sink system 100 comprising a visual indicator of water temperature 700. In a preferred embodiment, the visual indicator of water temperature 700 comprises colored lights, preferably LED lights. When water is hot, the lights are red, and they shine onto the flow of water 160, making it appear red. When water is cold, the lights are blue, and they shine onto the flow of water 160, making it appear blue. This is a useful feature for safety, especially for preventing children from burning their hands. The visual indicator of water temperature 700 may be embedded inside the channel 140. In another embodiment, the visual indicator of water temperature 700 may be attached to a separate fixture that can be fastened onto a directional nozzle 210 protruding from the channel 140.

The invention claimed is:

1. A sink system comprising:

a sink basin; and an articulated sink cover comprising a top surface, a bottom surface and a periphery that fits proximate to a periphery of the sink basin, the articulated sink cover further comprising a channel formed therein that extends from one side of the articulated sink cover to an opposite side of the articulated sink cover and passes through and terminates at an opening in the periphery on the opposite side of the articulated sink cover, wherein the channel is in direct communication with a water source and the sink basin, such that water flows from the water source through the channel out of the opening and into the sink basin.

2. The sink system of claim 1, wherein the articulated sink cover comprises acrylic polymer and alumina trihydrate.

3. The sink system of claim 1, wherein the articulated sink cover comprises a synthetic plastic polymer or metal.

4. The sink system of claim 1, wherein the articulated sink cover is attached to the sink basin by means of hollow, cylindrical hinges.

5. The sink system of claim 1, wherein the channel communicates with the water source by means of a hose fitting and flexible piping.

6. The sink system of claim 5, wherein the flexible piping extends into the channel.

7. The sink system of claim 1, wherein the sink basin comprises a gasket around the periphery thereof providing a water tight seal.

8. The sink system of claim 1, wherein the channel comprises a cylindrical configuration.

9. The sink system of claim 1, wherein the channel measures less than approximately one inch (2.54 cm.) in diameter.

10. The sink system of claim 1, further comprising one or more sensors and one or more valves to control temperature and water flow.

11. The sink system of claim 1, further comprising a digital display panel that displays a temperature and a flow rate of water.

12. The sink system of claim 1, further comprising a user interface.

13. The sink system of claim 12, wherein the user interface is controlled by hand gestures.

14. The sink system of claim 12, wherein the user interface is voice controlled.

15. The sink system of claim 1, further comprising a visual indicator of water temperature.

16. The sink system of claim 15, wherein the visual indicator comprises colored lights.

17. The sink system of claim 1, wherein the channel comprises a directional nozzle.

18. The sink system of claim 1, wherein the channel extends entirely through the articulated sink cover.

19. The sink system of claim 1, wherein the articulated sink cover comprises a substantially rectangular configuration.

* * * * *